United States Patent [19]

Naurath

[11] Patent Number: 4,466,780

[45] Date of Patent: Aug. 21, 1984

[54] PORTABLE AIR PUMP APPARATUS

[75] Inventor: Rolf H. Naurath, Naples, Fla.

[73] Assignee: Elco International, Ltd., Naples, Fla.

[21] Appl. No.: 229,153

[22] Filed: Jan. 28, 1981

[51] Int. Cl.[3] ..... F04B 35/04; F04D 29/42

[52] U.S. Cl. ..... 417/360; 415/219 C; 417/424

[58] Field of Search ..... 417/360, 361, 423 A, 417/424; 415/219 C, 219 R, 206

[56] References Cited

U.S. PATENT DOCUMENTS

| | | | |
|---|---|---|---|
| 1,269,063 | 6/1918 | DeLaval | 415/184 |
| 2,800,272 | 7/1957 | McKee | 417/424 X |
| 3,034,443 | 5/1962 | Hinrichs et al. | 417/360 X |
| 3,454,978 | 7/1969 | Kuwahara | 417/423 A |
| 4,004,862 | 1/1977 | Hill | 417/411 |
| 4,172,695 | 10/1979 | Vesugi | 417/424 |

*Primary Examiner*—Leonard E. Smith
*Attorney, Agent, or Firm*—Dick and Harris

[57] ABSTRACT

The present invention relates to a portable air pump apparatus that will take in air and cause it to flow through a lower chamber, direct it up and into a centrifugal impeller rotating in an upper chamber, concentrate its flow and dispell it at a greater than atmospheric pressure. The direction and concentration of the air flow taken in is accomplished by a cooperating network of curved baffles and sealed chambers.

3 Claims, 9 Drawing Figures

PORTABLE AIR PUMP APPARATUS

BACKGROUND OF THE INVENTION

The present invention relates generally to inflation or suction devices, and particularly, to a portable air pump apparatus.

Often, whether during recreational periods, travel or everyday activities, the need arises to inflate or deflate objects such as rubber rafts, air mattresses, air-filled boats, air-filled swimming items, and the like. However, rarely does one have the means to achieve such results in remote locations where even access to electricity is unlikely.

The present invention has the capacity to operate off of any 12 volt d.c. source such as the battery of a car, boat, or recreational vehicle.

The present invention also has as an object a light and compact design that makes it possible to be carried along during travel while occupying a minimum amount of space.

In addition, the present invention has as an object the avoidance of the unpleasant and physically demanding task of inflating objects such as rubber rafts, air mattresses, air-filled boats, and other air-filled items by using only one's lung power.

An additional object of the invention is the capability to provide a portable suction device also operable off any car, boat, or R.V. battery, simply by connecting the intake port of the present invention to the object sought to be deflated. This is achieved by providing separate intake and exhaust ports together with interchange nozzles affixable to the intake port when suction or deflation is desired and affixable to the exhaust port when inflation or pumping is desired.

Yet another object of the invention is to provide a system of baffles and chambers leading to and surrounding the impeller so as to draw in, direct, concentrate and expel the air flow at the highest rate possible. It serves to both minimize the size of the impeller housing and allows the use of a motor that is small enough to operate off the 12 volt d.c. current supplied by the car battery and yet still powerful enough to expel the air flow at a rapid rate. It must be remembered that often the only accessible power source within miles of the outdoor activity being conducted, is the battery of the car, boat, truck or R.V. used as transportation. This invention clearly exploits that readily accessible power source and provides an alternative to the two equally unattractive choices, namely, carrying objects in their already inflated condition or inflating the items without the aid of an electric pump.

Spark plug cleaners are illustrated in Fricke U.S. Pat. Nos. 4,202,141 and 4,165,586. However, it is believed, that the present invention differs considerably from the Fricke patents. In those inventions a system is provided for propelling particulate matter against a portion of automobile spark plugs inserted therein. However, the present invention presents a system of baffles, chambers, and vertical walls designed to draw in air flow, direct it towards a spinning impeller, concentrate the flow and then expel that flow. Particularly, the baffles, the vertical walls or bulkhead members and the horizontal separater plates cooperate to surround the rotating impeller and thereby provide a pre-determined path for the air flow through the housing. This cooperating network of baffles, plates and bulkhead members differs greatly from the inner-structure of the devices shown by the Fricke patents.

These and other objects of the invention will become apparent in light of the present specification and drawings.

SUMMARY OF THE INVENTION

The present invention comprises a portable air pump apparatus. In a preferred embodiment, the apparatus includes a hollow housing member comprising both an impeller housing and a motor housing. Each of the housings are held operably connected to one another. In addition, each of the housings are separable. Motorized drive means are mounted in the upper housing in such a way that its vertical drive shaft extends downwardly into the lower impeller housing. The motorized drive means comprises a motor driveable by a vehicle's power batter for remote actuation thereof. An impeller is mounted in the lower impeller housing and is operatively connected to the vertical drive shaft.

The impeller has an axial inlet opening located downwardly from the drive shaft and also has a plurality of vanes situated about the periphery thereof. The impeller housing also contains an intake port and an exhaust port. A first preferred embodiment is shown wherein the exhaust ports are situated diametrically opposed to each other. However, a second preferred embodiment is shown wherein the intake and exhaust ports are in vertical alignment. Attached to the ports are the exhaust or intake nozzle attachment means. Upper and lower baffling means are operably affixed to the impeller housings such that upon rotation of the impeller by the drive means, air is drawn in through the intake port, caused to flow through the lower baffling means and into the axial inlet opening of the impeller, discharged from the impeller vanes, directed along the upper baffling means and through the exhaust port.

The impeller is comprised of an upper impeller back plate, a lower impeller face plate, and a plurality of impeller vanes positioned between the back plate and the face plate around the periphery thereof. In addition, the lower face plate has a central axial inlet opening therein. A plurality of low profile vanes extend from the center of the impeller outwardly toward the impeller vanes.

The impeller housing further consists of an upper and a lower chamber. The upper and lower chambers are separated by a horizontal plate having an aperture formed therethrough. The lower chamber of the impeller housing contains an intake port while the upper chamber of the impeller housing contains the exhaust port. The impeller is positioned inside the upper chamber and directly above the aperture in the horizontal plate when the impeller housing and the motor housing are fitted together. A plurality of curvilinear lower bulkhead members affixed to the bottom surface of the horizontal separator plate comprise the lower baffling means. These lower bulkhead members substantially surround the aperture in the horizontal plate so as to direct the flow of air from the intake port to the aperture in the horizontal plate. Furthermore, the top edge of the upper bulkhead members sealably contacts the horizontal bottom surface of the upper motor housing thereby forming an impeller cavity containing the impeller, the aperture in the horizontal separator plate and the exhaust port when the motor housing and impeller housing are interfitted together.

Substantially surrounding the impeller is the upper bulkhead member when the upper motor housing is mated to the lower impeller housing so as to provide the passageway for air flow leading to the exhaust port from the impeller. The axial inlet opening of the impeller is correspondingly positioned proximately above the aperture in the horizontal plate. The impeller vanes are interposed between the lower horizontal surface of the motor housing and the horizontal separator plate and also are situated proximate the exhaust air passageway and the exhaust port.

Upon rotation of the impeller by the drive means, air is drawn in through the intake port in the lower chamber of the impeller housing. The air flow is then directed by the lower bulkhead members towards the aperture in the horizontal plate. The axial inlet opening of the impeller is positioned proximately above the horizontal plate so as to draw the air flow into the upper chamber of the impeller housing when the impeller is rotated by the drive means. Furthermore, the impeller cavity consisting of the upper bulkhead members, the lower horizontal surface of the motor housing and horizontal plate, serves to concentrate and direct the air flow from the impeller vanes of the impeller to the exhaust air passageway and subsequently to the exhaust port. Nozzles may also be provided interchangeably upon the intake or exhaust port nozzle attachment means, depending upon whether inflation or deflation of another object is desired.

DETAILED DESCRIPTION OF THE DRAWINGS

Figure 1:
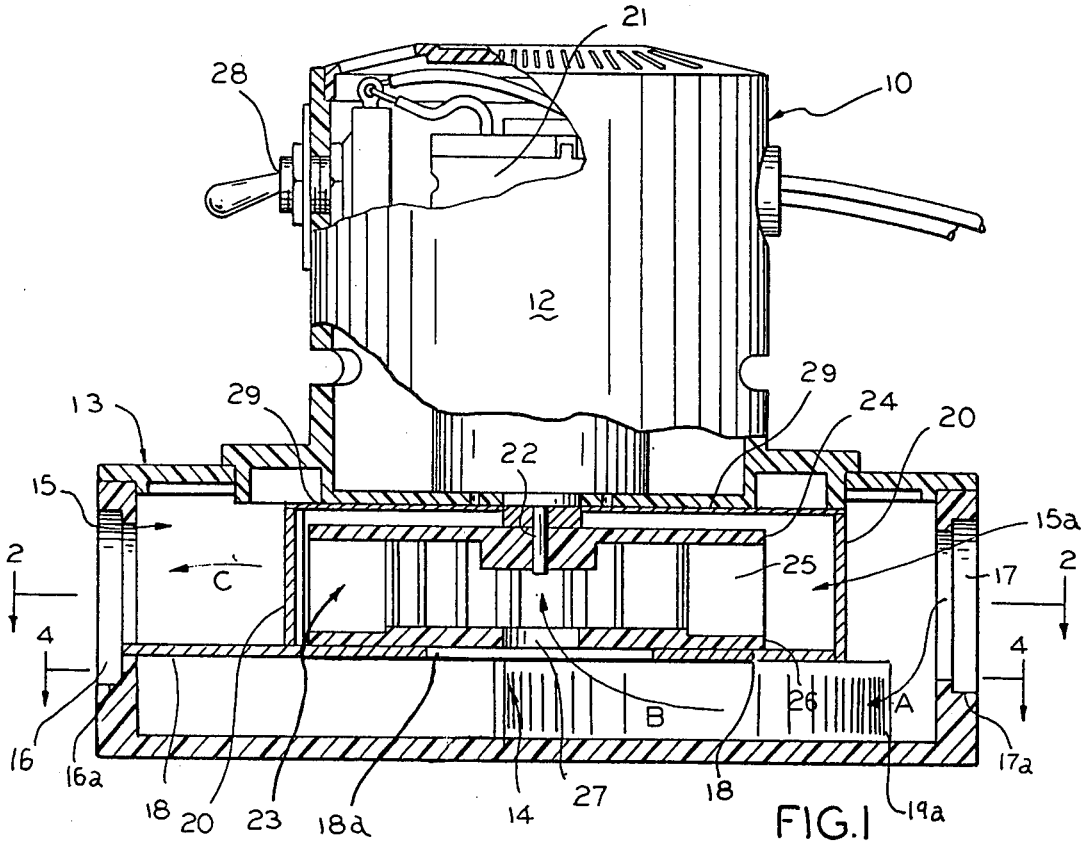
FIG. 1 is a front partial cross-sectional view of one embodiment of the portable air pump apparatus showing particularly the motor housing and impeller housing fitted together, and the intake and exhaust ports, upper and lower chambers, upper and lower bulkhead members and impeller contained in the impeller housing.

While this invention is susceptible of embodiment in many different forms, there are shown in the drawings and will herein be described in detail, two specific embodiments, with the understanding that the present disclosure is to be considered as an exemplification of the principles of the invention and is not intended to limit the invention to the embodiments illustrated.

A preferred embodiment of the invention is shown in FIG. 1 where the portable air pump apparatus 10 consists of motor housing 12 and impeller housing 13 air tightly mated together. Intake port 17 and exhaust port 16 are shown at opposite ends of impeller housing 13. Affixed at intake port 17 and exhaust port 16 are nozzle attachment means 17*a* and 16*a* respectively. Shown as being contained within motor housing 12, is motor 21 whose drive shaft 22 emanates from the motor housing 12 and protrudes into the impeller housing 13. Impeller 23 is shown operably affixed to drive shaft 22 and partially surrounded by upper bulkhead member 20.

Impeller 23 consists of an axial inlet opening 27 opening downwardly from the drive shaft 22, an upper impeller back plate 24, a lower impeller face plate 26, and a plurality of impeller vanes 25 positioned between back plate 24 and face plate 26 around the periphery thereof.

The horizontal separator plate 18 containing horizontal separator plate aperture 18*a* formed therethrough, serves to separate upper chamber 15 from lower chamber 14. Furthermore, upper bulkhead member 20 partially surrounding impeller 23 serves to define impeller cavity 15*a* included as part of upper chamber 15. As shown in FIG. 1, the top edge of upper bulkhead member 20 sealably contacts the lower horizontal surface 29 of motor housing 12 when motor housing 12 and impeller housing 13 are air tightly fitted together. Below horizontal separator plate 18 is shown lower chamber 14. Though not shown, lower bulkhead member 19 is firmly affixed to the bottom surface of horizontal separator plate 18 at its top edge, and affixed to the bottom surface of impeller housing 13 at its bottom edge. As shown, in FIG. 2, horizontal separator plate aperture 18*a* is positioned proximately below central axial inlet opening 27 of impeller 23.

Figure 2:
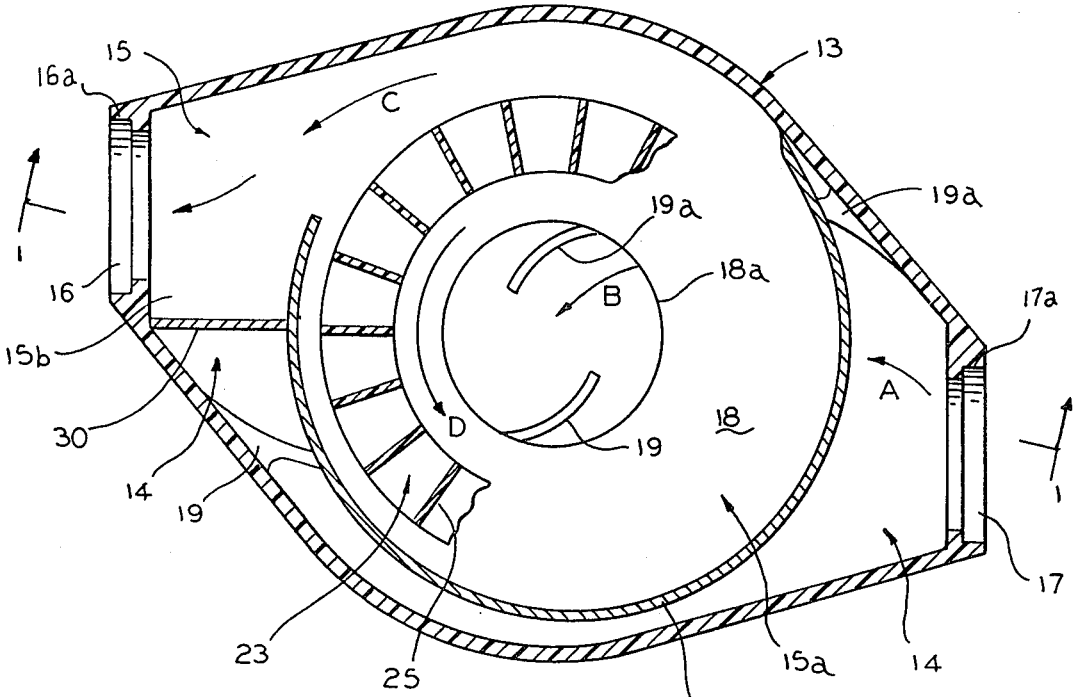
FIG. 2 is a top cross-sectional view of the impeller housing taken through lines 2—2 of FIG. 1 and looking in the direction of the arrows, showing particularly the intake and exhaust ports, impeller, and upper and lower bulkhead members.

When rotation is supplied by the motor 21 to the impeller 23, air is drawn in through intake port 17 as shown by arrow A of FIGS. 1 and 2, directed along lower bulkhead member 19 toward the axial inlet opening of impeller 23 and through horizontal separator plate aperture 18*a* as shown by arrow B, and into impeller cavity 15*a*. Rotating impeller 23 then causes the air flow to be directed tangentially away from the rotating impeller vanes 25 into the remainder of upper chamber 15 and subsequently through exhaust port 16 as shown by air flow arrow C.

A cross-sectional view taken along line 2—2 and looking in the direction of the arrows of FIG. 1 of the impeller housane 13 is shown in FIG. 2. Upper bulkhead member 20 is shown partially surrounding impeller 23 thereby defining impeller cavity 15a. Horizontal separator plate 18 and upper bulkhead member 20 perpendicular thereto, define upper chamber 15. Also shown in FIG. 2 is a portion of lower chamber 14 containing lower bulkhead members 19 and 19a. In FIG. 2, lower chamber 14 and particularly lower bulkhead members 19 and 19a are partially visible through horizontal separator plate aperture 18a. In addition, also shown are bulkhead support 30 and intake port 17 and exhaust port 16 which are diametrically opposed to one another and have affixed to them nozzle attachment means 17a and 16a, respectively.

Rotation of impeller 23 in the direction shown by the arrow D in FIG. 2, results in air being drawn in through intake port 17 in lower chamber 14. The air flow is then directed as shown in air flow arrow B by the lower bulkhead members 19 and 19a towards horizontal separater plate aperture 18a and up into axial inlet opening 27 of impeller 23 and impeller cavity 15a of upper chamber 15. As shown by air flow arrow C, rotating impeller 23 subsequently discharges the air flow into the remainder of upper chamber 15, namely, exhaust air flow passageway 15b where it is concentrated and directed out through exhaust port 16.

Figure 3:
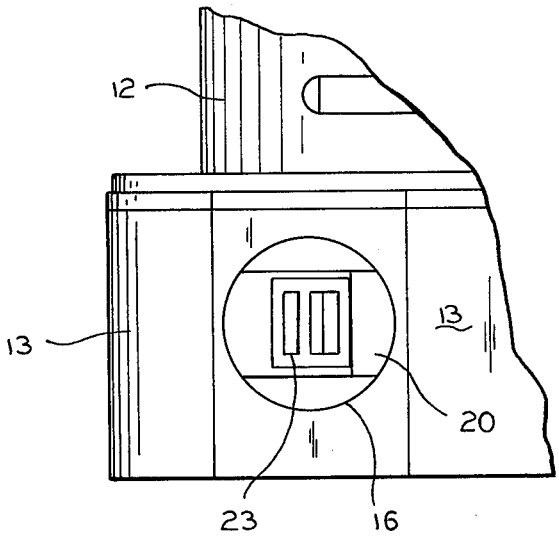
FIG. 3 is a partial side elevational view showing particularly the motor housing and impeller housing interfitted together, the exhaust port, upper bulkhead member and impeller.

A partial side elevational view is shown in FIG. 3 of motor housing 12 and impeller housing 13 sealably fitted together. Also visible through exhaust port 16, are upper bulkhead member 20 and impeller 23.

Figure 4:
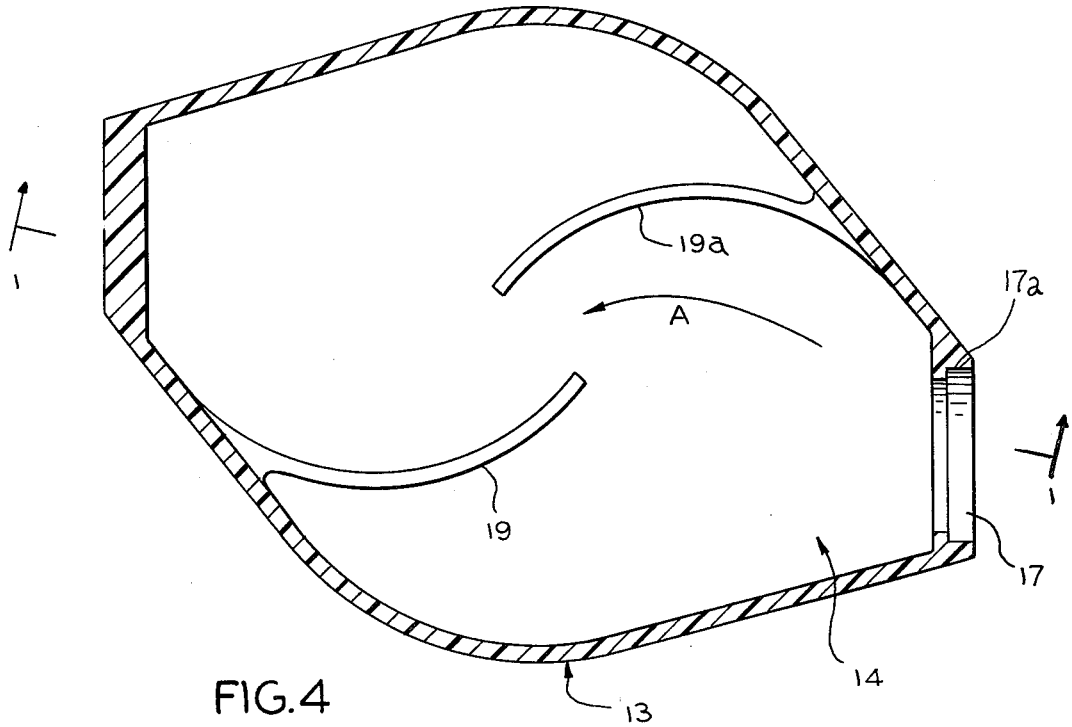
FIG. 4 is a top cross-sectional view of the impeller housing taken along lines 4—4 of FIG. 1 and looking in the direction of the arrows showing particularly the intake port and the lower bulkhead members.

Yet, another cross-sectional view of impeller housing 13, taken through line 4—4 of FIG. 1 is shown in FIG. 4. Intake port 17 is shown as are lower bulkhead members 19 and 19a within lower chamber 14. Also shown is optional nozzle attachment means 17a. As shown by air flow arrow A, rotation of impeller 23 shown in FIG. 1 and FIG. 2 causes air to be drawn in through intake port 17 and directed through the center of lower chamber 14 and up to impeller cavity 15a passing through horizontal separator plate 18a.

Though not shown in the drawings, a nozzle may be affixed at either the intake or exhaust port nozzle attachment means 16a or 17a depending on whether inflation or suction is desired so as to further concentrate said air flow.

Figure 5:
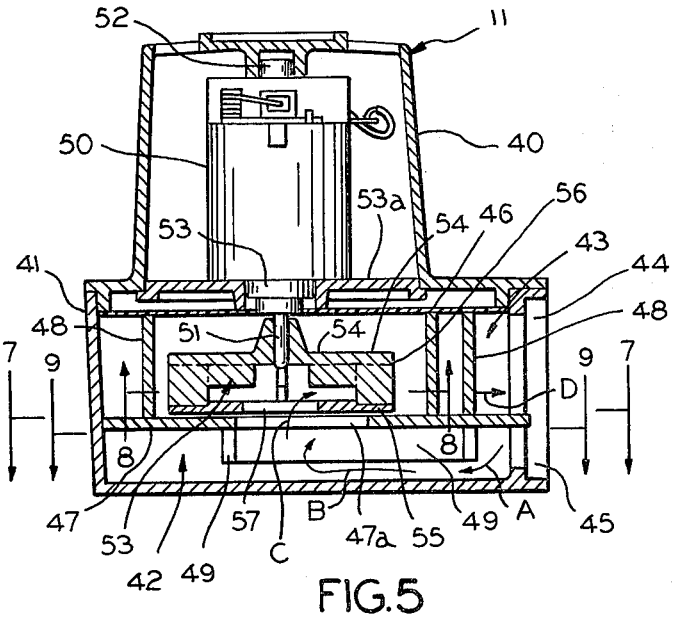
FIG. 5 is a front cross-sectional view of a second embodiment of the present invention taken along lines 5—5 and looking in the direction of the arrows of FIG. 6 showing particularly the motor housing and the impeller housing interfitted together, the motor contained within the motor housing, and the impeller and drive shaft, upper and lower bulkhead members, upper and lower chambers, and the exhaust and intake ports contained within the impeller housing.
Figure 6:
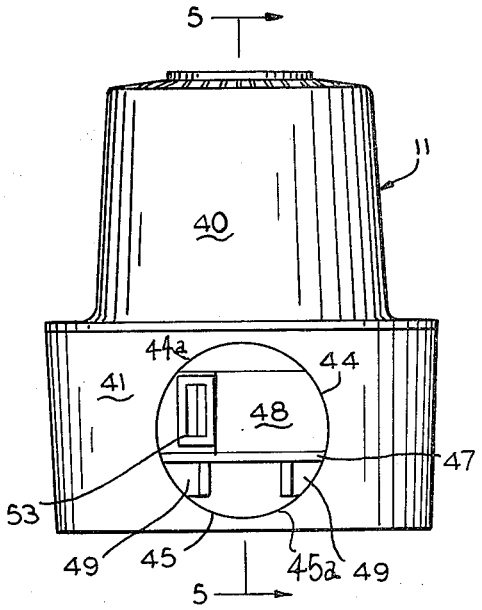
FIG. 6 is a side elevational view of the second embodiment of the invention, showing particularly the motor and impeller housings interfitted together, the intake and exhaust ports, the upper and lower bulkhead members, and the impeller contained within the impeller housing.

The second preferred embodiment of the invention is shown in FIG. 5 where the portable air pump apparatus 11 consists of motor housing 40 air tightly fitted to impeller housing 41. FIG. 5 is a side cross-sectional view taken along 5—5 of FIG. 6 showing as contained in motor housing 40, the motor 50 secured by motor brackets 53a and having drive shaft 51 emanating downward into impeller housing 41. Impeller 53 is shown operably affixed to drive shaft 51 and contained within upper chamber 43. Shown as separating upper chamber 43 from lower chamber 42 is horizontal separator plate 47 containing horizontal separater plate aperture 47a. Also shown in FIG. 5 above horizontal separater plate 47 is exhaust port 44. Affixed to exhaust port 44 is nozzle attachment means 44a.

Located proximately directly above aperture 47a in horizontal separator plate 47 is axial inlet opening 57 of impeller 53. Impeller 53 further consists of an upper impeller back plate 54 and a lower impeller face plate 55 containing the axial inlet opening 57. Positioned between back plate 54 and face plate 55 are a plurality of impeller vanes 56. In addition, partially surrounding impeller 57 within upper chamber 43, is upper bulkhead member 48. As shown in FIG. 5, the top edge of upper bulkhead member 48 sealably contacts a bottom horizontal surface 46 of motor housing 40 so as to form impeller cavity 43a shown in FIG. 7. The bottom edge of upper bulkhead member 48 is affixed to the top surface of horizontal separator plate 47.

Intake port 45 is also shown in FIG. 5 as leading into lower chamber 42. Nozzle attachment means 45a is shown affixed to intake port 45. Affixed to the bottom surface of horizontal separator plate 47 is lower bulkhead member 49. As impeller 53 is rotated by motor 50, air is drawn in through intake port 45 and directed by lower bulkhead member 49 towards aperture 47a in horizontal separator plate 47 as shown by air flow arrows A and B. Upon passage through aperture 47a, the air flow enters axial inlet opening 57 of impeller 53 and exits tangentially to rotating impeller 53 through impeller vanes 56 as shown by air flow arrow D, and subsequently through exhaust port 44.

A front elevational view of the second preferred embodiment of the portable air pump apparatus 11 is shown in FIG. 6. Shown air tightly fitted together are motor housing 40 and impeller housing 41. Furthermore, visible through intake port 45 are lower bulkhead members affixed to the bottom surface of horizontal separator plate 47. Also, impeller 53 and upper bulkhead member 48 are partially visible through exhaust port 44.

Figure 7:
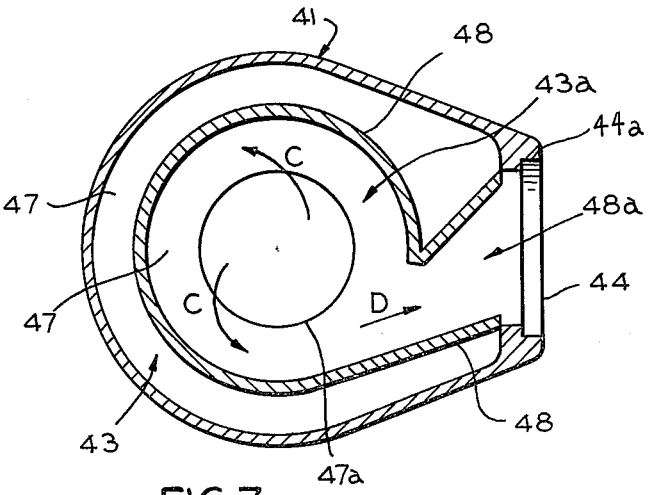
FIG. 7 is a top cross-sectional view of the impeller housing taken along lines 7—7 of FIG. 5 and looking in the direction of the arrows, showing particularly the upper bulkhead member, the horizontal separator plate, the aperture in the horizontal separator plate, the impeller cavity, the exhaust air passageway and the exhaust port.

As viewed along lines 7—7 of FIG. 5, impeller housing 41 contains horizontal separator plate 47 containing an aperture 47a formed therethrough, upper bulkhead member 48 partially surrounding the separator plate aperture 47a and exhaust port 44, in FIG. 7. Upper chamber 43 consisting of a portion of impeller housing 41 above horizontal separater plate 47 in FIG. 5, is divided by upper bulkhead member 48 into impeller cavity 43a and exhaust air passageway 48a. As shown by air flow arrows C and D, impeller 53 rotating within impeller cavity 43a and proximately above aperture 47a in horizontal separator plate 47 serves to draw the air flow into upper chamber 43 and specifically into impeller cavity 43a and subsequently exhaust air passageway 48a, where the flow is concentrated and directed out past exhaust port 44.

Figure 8:
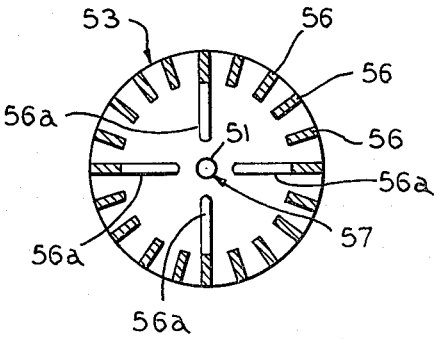
FIG. 8 is a bottom cross-sectional view of the impeller taken along lines 8—8 of FIG. 5 and looking in the direction of the arrows showing particularly the impeller vanes and the drive shaft affixed at the center thereof.

FIG. 8 is a cross-sectional view of impeller 53 taken along line 8—8 of FIG. 5 showing particularly drive shaft 51 affixed at the center of the impeller, impeller vanes 56 and low profile vanes 56a arranged about the periphery of impeller 53 and axial inlet opening 57 located within the impeller vanes 56 and 56a.

Figure 9:
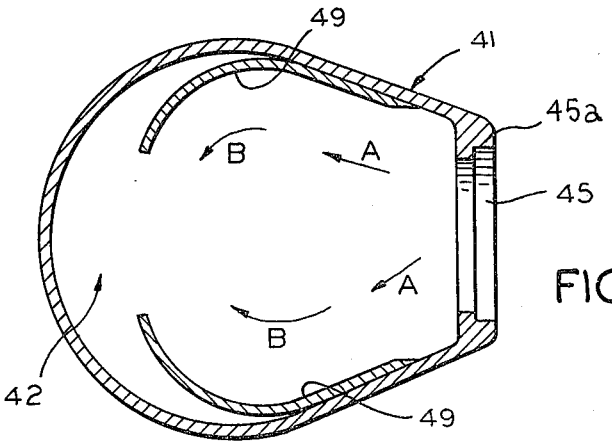
FIG. 9 is a top cross-sectional view of the impeller housing taken along lines 9—9 and looking in the direction of the arrows of FIG. 5 showing particularly the lower chamber, lower bulkhead members, and the intake port.

An additional top cross-sectional view of impeller housing 41 is provided along lines 9—9 of FIG. 5, in FIG. 9. Shown are lower bulkhead members 49 within lower chamber 42. As air flow is drawn in past intake port 45 by the rotating impeller 53, the lower bulkhead members 49 serve to direct the air flow as shown by air flow arrows A and B, towards aperture 47a and upper chamber 48 as shown in FIG. 7.

In summary, as herein described, rotation of impeller 53 situated within upper chamber 43 serves to draw the air flow through intake port 45 in lower chamber 42, the air flow is then directed by lower bulkhead members 49 towards the aperture 47a in horizontal separator plate 47, consequently past the aperture 47a and into the axial inlet opening 57 of impeller 53. The air flow is then discharged tangentially to the impeller vanes 56 and 56*a*. Upper bulkhead member 48 then serves to concentrate and direct the air flow through impeller cavity 43*a*, exhaust air passageway 48*a*, and subsequently out through exhaust port 44, in upper chamber 43 as shown in FIG. 5, FIG. 7 and FIG. 9.

Though not shown in the drawings, a nozzle may be affixed at either the intake or exhaust port nozzle attachment means 44*a* or 45*a*, depending upon whether inflation or suction is desired so as to further concentrate said air flow.

The foregoing descriptions and drawings merely explain and illustrate the invention, the invention is not limited thereto, except insofar as the appended claims are so limited, as those skilled in the art who have the disclosures before them will be able to make modification and variations therein without departing from the spirit and scope of the invention.

What is claimed is:

1. A portable air pump apparatus comprising:

a hollow housing member including a substantially cylindrical impeller housing and a substantially cylindrical motor housing in operable alignment therewith;

each of said impeller and motor housings being operably attached in said alignment to one another along a bottom portion of said motor housing, said bottom portion of said motor housing further sealably separating said motor housing from said operably aligned impeller housing;

motorized drive means mounted in said motor housing having a vertical drive shaft extending from a first shaft end downwardly through said motor housing bottom portion towards and into said impeller housing;

an impeller operatively connected proximate to a second end of said vertical drive shaft within said impeller housing, said first shaft end substantially opposite said second shaft end, said impeller having an axial inlet opening described along a bottom side thereof and, said axial inlet further including a plurality of vanes radiating outwardly to a position proximate to the periphery of said impeller;

said impeller housing including both an upper and a lower chamber, said impeller housing further including exhaust port means in said upper chamber and intake port means in said lower chamber respectively, said upper and lower chambers within said impeller housing being separated by a substantially horizontal separator plate having an aperture formed therethrough to permit the flow of air from said lower chamber through and into said upper chamber;

upper baffling means operably affixed within said upper chamber and lower baffling means operably affixed within said lower chamber to prompt air that is drawn through said intake port upon the rotation of said impeller by said drive means to be directed through said lower baffling means and into said axial inlet opening of said impeller for discharge from said impeller by said vanes and, in turn, directed through said upper baffling means towards and out said exhaust port;

the bottom of said lower chamber being defined by a bottom surface portion of said impeller housing;

said lower baffling means comprising one or more curvilinear upright lower bulk head members positioned between said horizontal separator plate and said bottom surface portion of said lower chamber;

said lower bulk head members further having a continuous substantially curvilinear shape for the purpose of continuously and efficient routing and directing said air into one or more substantially circulating masses at a position proximate to and below the aperture formed in said horizontal separator plate;

said rotation of said impeller, in either direction, creating a vacuum so as to draw air from the lower chamber, through said aperture in said horizontal separator plate and into said upper chamber as a function of suction created at the axial inlet of said impeller;

said upper baffling means serving to direct said routed and directed air emanating from said impeller vanes towards and out said exhaust port;

said air being routed and directed continuously and efficiently towards and out said exhaust port and being precluded from entry into said lower chamber by said substantially horizontal separator plate which seals the inadvertent and undesirable flow of air between said chambers to any point other than unidirectionally through said aperture formed therethrough;

said upper and lower chambers cooperating with said horizontal separator plate, the aperture formed therethrough, said upper and lower baffling means, said intake and exhaust port and said axial inlet opening of said rotating impeller together with its vanes, to describe a circulatable air passageway into and through said lower chamber towards, into and out from said upper chamber, upon the rotation of said impeller, regardless of the direction of such rotation; said upper baffling means including a plurality of upper bulkhead members having a top edge and a bottom edge, said bottom edge of said upper bulkhead members being affixed to said horizontal separator plate, said top edge of said upper bulkhead member sealably contacting said horizontal bottom surface of said upper motor housing to form said upper chamber containing said impeller;

said upper bulkhead member substantially surrounding said impeller to provide a passageway for air flow leading to said exhaust port from said impeller, said axial inlet opening on said impeller being positioned proximately above said aperture in said horizontal plate, said impeller vanes being interposed between said bottom surface portion of said motor housing and said horizontal separator plate; and said intake port and said exhaust port being substantially diametrically opposed in position within said apparatus to permit the entry and exit of circulated air into and out of said air pump apparatus in directions substantially normal to said vertical drive shaft.

2. The apparatus as recited in claim 1 wherein said operably attached motor housing and impeller housing are in a removable attachment.

3. The apparatus as recited in claim 1 wherein said motorized drive means comprises a motor driveable by a vehicle's power battery for remote actuation thereof.

* * * * *

UNITED STATES PATENT AND TRADEMARK OFFICE

CERTIFICATE OF CORRECTION

PATENT NO. : 4,466,780

DATED : August 21, 1984

INVENTOR(S) : Rolf H. Naurath

It is certified that error appears in the above-identified patent and that said Letters Patent is hereby corrected as shown below:

| | |
|---|---|
| Column 5, line 5 | "housane" should be instead -- housing --. |
| Column 5, line 61 | "separater" should be instead -- separator --. |
| Column 8, line 7 | "efficient" should be instead -- efficiently --. |

Signed and Sealed this

*Twenty-sixth* Day of *March 1985*

[SEAL]

*Attest:*

DONALD J. QUIGG

*Attesting Officer*

*Acting Commissioner of Patents and Trademarks*